United States Patent [19]

Wandel et al.

[11] 4,248,934

[45] Feb. 3, 1981

[54] FIBRE AND FILAMENT MIXTURES CONTAINING HIGH-SHRINKAGE BIFILAR POLY(MOD)ACRYLIC FILAMENTS OR FIBRES MODIFIED WITH CARBON BLACK

[75] Inventors: Martin Wandel; Helmut Engelhard; Ernst Gutschik; Manfred Reichardt; Geert Christoph, all of Dormagen, Fed. Rep. of Germany

[73] Assignee: Bayer Aktiengesellschaft, Leverkusen, Fed. Rep. of Germany

[21] Appl. No.: 922,120

[22] Filed: Jul. 5, 1978

[30] Foreign Application Priority Data

Jul. 7, 1977 [DE] Fed. Rep. of Germany ..... 2730643

[51] Int. Cl.[3] ..... D02G 3/04

[52] U.S. Cl. ..... 428/374; 260/42.48; 260/DIG. 17

[58] Field of Search ..... 428/374; 260/DIG. 21, 260/DIG. 19, DIG. 17, 42.21, 42.48

[56] References Cited

U.S. PATENT DOCUMENTS

| | | | |
|---|---|---|---|
| 3,718,716 | 2/1973 | Joh et al. | 260/DIG. 21 |
| 3,801,553 | 4/1974 | Yamaguchi et al. | 260/DIG. 17 |
| 3,821,176 | 6/1974 | Drend et al. | 260/DIG. 19 |
| 3,835,148 | 9/1974 | Oxe et al. | 260/DIG. 19 |
| 3,849,242 | 11/1974 | Takeya et al. | 428/374 X |
| 3,969,559 | 7/1976 | Boe | 428/374 X |

*Primary Examiner*—Lewis T. Jacobs

*Attorney, Agent, or Firm*—Sprung, Felfe, Horn, Lynch & Kramer

[57] ABSTRACT

The invention relates to fibre or filament mixtures consisting of high shrinkage side-by-side bifilar (mod)acrylic fibres or filaments separately containing $TiO_2$ and carbon black and of normal fibres or filaments of polyamide, polyester, polyalkylene, poly(mod)acrylic, wool or cotton.

5 Claims, 1 Drawing Figure

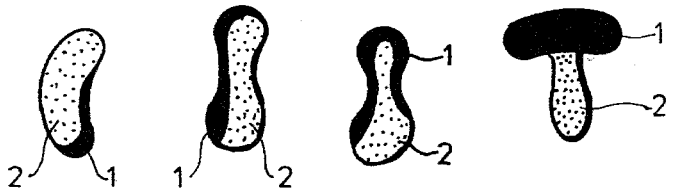
2
1
1
2
1
2
1
2

FIBRE AND FILAMENT MIXTURES CONTAINING HIGH-SHRINKAGE BIFILAR POLY(MOD)ACRYLIC FILAMENTS OR FIBRES MODIFIED WITH CARBON BLACK

This invention relates to fibre and filament mixtures consisting of high-shrinkage bifilar side-by-side poly(-mod)acrylic fibres or filaments separately containing carbon black and $TiO_2$ and fibres or filaments which have not been modified by carbon black, for example polyamide, polyester, polyalkene, poly(mod) acrylic, wool or cotton.

German Patent Application No. P 26 39 499.0 teaches that it is possible inter alia to produce textile articles with excellent antistatic properties from fibre and filament mixtures consisting of 0.1 to 20% by weight of a polyacrylic filament or fibre containing from 5 to 25% by weight of carbon black and having a boiling-induced shrinkage of from 10 to 50%, and 99.9 to 80% by weight of a normal synthetic filament or fibre, the conspicuousness of the black filament or fibre in the textile being reduceable either partially or completely by releasing shrinkage.

However, it would be even more advantageous if the conductive, high shrinkage fibre or the corresponding filament did not have the natural colour of carbon black, but a lighter colour instead, whilst at the same time retaining the antistatic effect in order to completely avoid a negative optical appearance.

It has now been found that the bifilar spinning of a $TiO_2$-containing solution of an acrylonitrile copolymer or of a mixture of acrylonitrile copolymers in the usual way against a carbon-black-containing solution of an acrylonitrile copolymer or of a mixture of any acrylonitrile copolymers, followed by careful aftertreatment, gives high-shrinkage grey-coloured side-by-side bifilar fibres or filaments which, in their fully shrunk state, have permanent surface resistances of from $10^{11}$ to $10^3$ ohms (as measured at 23° C./50% relative humidity), depending upon the type and quantity of carbon black used. It has also been found that these bifilar fibres or filaments can be mixed with other filaments or fibres, for example of poly(mod)acrylic, polyamide, polyester, polyalkene, wool or cotton, in a proportion of from 0.1 to 20% by weight, based on the mixture as a whole, to obtain sheet-form textiles such as, for example, floor coverings, and woven or knitted fabrics, which are sufficiently antistatic for practical requirements. It has also been found that the conspicuousness of the grey areas in the textile article attributable to these bifilar fibres or filaments can be completely avoided if, during the production or finishing of the textile article, provision is made for a treatment designed to initiate shrinkage of the bifilar fibres or filaments such as, for example, by boiling, dyeing, steaming, printing, latexing or other finishing processes carried out at an elevated temperature (approximately 100° C.). The articles produced from fibre yarn or filament yarn mixtures of the type in question do not show any streakiness.

Accordingly, the present invention provides fibre and filament mixtures of 0.1 to 20% by weight and preferably 0.2 to 10% by weight of high shrinkage side-by-side bifilar acrylic fibres or filaments separately containing carbon black and $TiO_2$, and 99.9 to 80% by weight, preferably 99.8 to 90% by weight, of normal synthetic or natural fibres or filaments of polyamide, polyester, poly(mod)acrylic, polyalkene, wool or cotton.

The bifilar fibres or filaments contain two separate side-by-side surfaces as seen in cross-section, one side containing $TiO_2$ and the other side carbon black. Based on the filament or fibre as a whole, the quantity of $TiO_2$ preferably amounts to between 0.01 to 3.6% by weight and the quantity of carbon black preferably to between 1.2 and 27% by weight.

In order to obtain the best possible turn out of the finished textile article, the boiling-induced shrinkage of the filaments or fibres separately containing carbon black and $TiO_2$ should amount to between 10 and 50% and preferably to between 20 and 40%.

The surface resistance of the fully shrunk bifilar mod-(acrylic) fibres or filaments amounts to between $10^3$ and $10^{11}$ ohms (as measured in accordance with DIN 54 345, page 1, at 23° C./50% relative humidity after 10 washes). In this connection, it is extremely surprising that it is only the shrinkage process which alters the surface resistance by 3 to 10 powers of ten and adjusts it to the required value.

The production of the high shrinkage bifilar (mod)acrylic filaments and fibres separately containing carbon black and $TiO_2$ and their processing are described hereinafter.

To prepare for the production of the bifilar fibres or filaments, two solutions A and B of an acrylonitrile copolymer or of a mixture of two or more acrylonitrile copolymers are separately prepared, one containing $TiO_2$ and the other carbon black. The solids contents, i.e. the sum of poly(mod)acrylonitrile/poly(mod)acrylonitriles+$TiO_2$ and carbon black, of both pigmented solutions preferably amounts to between 20 and 40%. The $TiO_2$ in solution A preferably amounts to between 0.1 and 4%, based on the solids content, whilst the carbon black in solution B preferably amounts to between 12.5 and 30%, based on its solid content. High-speed stirring helps to ensure complete dispersion but dispersion can be promoted by additionally introducing small quantities of an emulsifier. The ratio by volume of the two component streams A and B to one another amounts to between 90:10 and 10:90 and preferably to between 75:25 and 25:75. The viscosities of the two pigmented solutions, as measured at 80° C., are normally variable over a range from 5000 mPa.s to 50,000 mPa.s, the range from 20,000 to 40,000 mPa.s being preferred. For spinning through a jet suitable for the bifilar process, the viscosities of the two streams delivered separately to this jet are preferably equal as far as is possible to one another but in special cases different viscosities of the two streams are important because in this way it is possible inter alia to influence the cross-sections of the bifilar poly(mod)acrylic fibres. Spinning is carried out by either the dry spinning or the wet spinning process, but preferably by the dry spinning process. Suitable solvents are any of those known to the skilled man, although dimethyl formamide and dimethyl acetamide are preferably used. The spinning bands are then freed from the solvent by washing, drawn in a ratio of 1.5 to 3:1 in a dry form or in water, at a temperature of between 40° and 80° C. It should be noted that the antistatic behaviour of the stretched fibres or filaments is depending on the ratio of drawing. A high ratio increases the surface resistance. They are then treated with a preparation and dried at 40° to 80° C. If desired, a crimping step may also be incorporated.

The order in which washing and drawing are carried out may also be switched.

The grey colour of these bifilar filaments and fibres may be determined by the ratio of $TiO_2$ to carbon black which is present therein. Since this ratio can be influenced not only by the quantities of $TiO_2$ and carbon black present in the two component solutions which are spun against one another, but also by the quantities of pigmented solution delivered to the spinning jet, it is important to adjust the ratio of $TiO_2$ to carbon black in such a way that, in addition to the fibres or filaments being desirably lightened by $TiO_2$, the fully shrunk bifilar(mod)acrylic fibres and filaments are guaranteed adequate antistatic properties by having a surface resistance of from $10^3$ to $10^{11}$ ohms. It has therefore proved favourable to spin the two polymer streams A and B against one another in a ratio by volume of A:B of from 90:10 to 10:90, preferably from 75:25 to 25:70, their solids content (i.e. the sum of poly(mod)acrylonitrile/-poly(mod)acrylonitriles+$TiO_2$ and carbon black being between 20 and 40% by weight and the additions of pigment being between 0.1 and 4% by weight for $TiO_2$ and between 12.9 and 30% by weight for carbon black, based on the solids contents of the individual solutions.

The carbon blacks used are preferably those having relatively high conductivity. Generally speaking, suitable carbon blacks are those which have an average particle diameter of from 10 to 60 mμ, preferably from 15 to 40 mμ, and a surface area ($N_2$) of from 60 to 300 $m^2/g$, preferably from 90 to 260 $m^2/g$.

The acrylonitrile copolymers used for the purposes of the present invention may be any of those commonly used for the production of synthetic acrylic fibres or filaments. The products in question are primarily substrates of the type in which at least 85% by weight consists of acrylonitrile, although pure acrylonitrile homopolymer may also be used. Suitable comonomers for the copolymers are (meth)acrylates, vinyl carboxylates, (meth)allyl carboxylates, (iso)butenyl carboxylates, maleates, fumarates, (meth)acrylamides and N-substituted derivatives thereof, vinyl ethers, styrene and derivatives thereof, alkenes, methacrylonitrile, dye additives such as, for example, (meth)acrylic acid, itaconic acid, maleic acid, vinyl-, (meth)allyl-, styrene-sulphonic acid, sulpho(meth)acrylates, vinyl-, (meth)-allyl phosphonic acid, N-sulphoalkyl(meth)acrylamide, vinyl pyridine, vinyl imidazole, vinylalkyl pyridines, vinylalkyl imidazoles, (dialkyl)aminoalkyl(meth)acrylates, and N-(dialkyl)-aminoalkyl-(meth)acrylamides. The polymers preferably have K-values (Fikentscher, Cellulosechemie 13, 1932, page 58) in the range of from 70 to 100.

The polymers contained in each of the two component streams may be the same or different. If mixtures of polymers are used in component solutions A and/or B, it is possible for such a mixture to be composed of polymers which contain the same dye functions, i.e. either acid or basic. In this case, the difference between the two polymers in the mixture lies particularly in the content of these dye functions. The quantities in which the two polymers are used are selected in such a way that the ratio by weight of the polymer having the higher content of dye function to the polymer having the lower content of dye function preferably amounts to 1–25:99–75. Furthermore, it is also possible to use a mixture of polymers which contain differing dye functions, such as for example an acid group on one hand and a basic group on the other, i.e. where intermediate salt formation can be carried out by way of the two polymers. The ratio of these two polymers lies in the range from 1:99 to 99:1 and preferably in the range from 40:60 to 60:40.

The cross-sections of the bifilar poly(mod)acrylic fibres or filaments obtained may be round, dumbbell shaped, bean shaped, mushroom shaped or lip-shaped. The separation surfaces of the two polymer constituents A and B are discernible under an optical microscope.

In order to make the cross-sections visible and to discern the separation surfaces, microtome sections are prepared (see FIG. 1). For this, 10 filaments are introduced into a 4 cm long, 6 mm wide glass tube, a synthetic resin and a starter are introduced into the tube, the two ends of which are subsequently corked. The tube is then tempered for 30 minutes at 130° C. which causes the contents to solidify. The contents are then removed together with the co-polymerised filaments and cut transversely into approximately 10 μm thick wafers. The cross-sections are then discernible in transmitted light under a microscope. In FIG. 1, the reference 1 denotes carbon black and the reference 2 denotes $TiO_2$.

The bifilar poly(mod) acrylic fibres or filaments separately containing $TiO_2$ and carbon black normally have boiling-induced shrinkages of from 10 to 50%, advantageously from 20 to 40%, and a surface resistance value of from $10^3$ to $10^{11}$ ohms in their fully shrunk state, (as measured in accordance with DIN 54 345, page 1, at 23° C./50% relative humidity) are permanently antistatic. Even frequent washing does not alter this.

In order to produce textile articles from these special fibres or filaments, in particular floor coverings, but also knitted woven and non-woven fabrics, spun fibre or filament yarn mixtures are prepared from 99.9 to 80% by weight of aliphatic or aromatic polyamide, polyester, poly(mod)acrylic or polyalkene fibres or filaments, wool or cotton, and 0.1 to 20% by weight of the high shrinkage bifilar(mod)acrylic fibres or filaments separately containing carbon black and $TiO_2$. After treatment to release shrinkage, by the usual and necessary finishing processes, such as dyeing for example, the sheet-form articles produced in the usual way from these filament yarn or spun fibre mixtures are not influenced in their appearance by the presence of the medium or high-shrinkage grey fibres or filaments fully shrunk in the finished article. Conversely, normal-shrinkage fibres or filaments containing carbon black are known to be visible in the finished article.

If desired, antistatic additives may also be used in any finishing process to which the particular textile articles may be subjected. Examples of the fibres or filaments used as the main component of the fibre or filament mixtures are those of poly-ε-caprolactam, polyhexamethylene adipic amide, polyamino undecanoic acid, polypyrrolidone, poly(isophthaloyl)-m-phenylene diamide, polyethylene glycol terephthalate, polycyclohexane-1,4-dimethylol terephthalate, polybutylene glycol terephthalate, polypivalolactone, poly-(1-hydroxyethoxy-4-carboxybenzene), polyethylene, polypropylene, poly-(acrylonitrile methacrylate), poly-(acrylonitrile-vinylacetate), poly-(acrylonitrile-vinylidene chloride), and poly-(acrylonitrile-vinyl chloride). It is however, preferred to use poly-ε-caprolactam, polyhexamethylene adipic amide, polyethylene glycol terephthalate, polycyclohexane-1,4-dimethylol terephthalate, poly-(acrylonitrile methacrylate) or polypropylene.

The finished textile articles obtained from the fibre or filament mixtures show properties characteristic of the basic fibres or filaments. These include, for example, good textile data, utility values, gloss, appearance, and dyeability, as well as being permanently antistatic. In the case of floor coverings for example, the antistatic properties is reflected in the fact that, when the floor coverings are walked on, even in rooms of low humidity, no effects attributable to electrostatic charging, for example shocks, are felt. For instance, charges of from 200 to a maximum of 1800 volts have been measured (in accordance with DIN 54 345, page 2) in people walking on velour carpets produced in this way and provided with an antistatic consolidating finish. With other textile articles such as, for example, knitted pullovers, the permanent antistatic effect eliminates the known unpleasant charging and discharging phenomena, for example crackling and sparking, during dressing and undressing. Another advantage is that these permanently antistatic articles can also be produced in light colours.

Another property of note, particularly in the case of floor coverings produced in accordance with the present invention, is that their sensitivity to water stains is no higher than that of floor coverings consisting entirely of normal synthetic fibres or filaments mentioned above.

To determine boiling-induced shrinkage, 10 individual capillaries are fastened with clips at their ends and vertically suspended, the capillary length being previously determined. They are then immersed in boiling water for 2 minutes and their length subsequently remeasured. The difference between the initial length and the final length is converted into a percentage of their original length. Measurement is carried out 10 times and the results averaged out.

Testing of the antistatic effect in fibres, filaments, yarns and sheet-form textiles is carried out by measuring the electrical resistance values in accordance with DIN 54 345, page 1, and in the case of floor coverings also in accordance with DIN 54 345, page 2.

The textile properties, the utility values of the textile articles and the fastness values (fastness to light, and fastness to dyeing) are determined by known tests. Sensitivity to staining by water is determined as follows: 50 ml of desalted water is poured onto the carpet, followed after complete drying in air by evaluation with the grey scale according to DIN 54001.

The production of the antistatic bifilar acrylic fibres and filaments separately containing carbon black and $TiO_2$, which were subsequently mixed with polyamide and polyacrylic fibres and made up into textile articles, is described in the following.

EXAMPLE 1

Production of bifilar acrylic fibres separately containing carbon black and $TiO_2$ using the same polymers.

1. Production of the $TiO_2$ stock mixture 0.4 kg of isononyl phenol polyglycol ether was added with stirring to 9.2 kg of dimethyl formamide. 4 kg of $TiO_2$ was then slowly added with cooling and stirring, followed by further stirring at room temperature for 1.5 hours. 6 kg of a 29% DMF solution of a copolymer of 94% by weight of acrylonitrile, 5.5% by weight of methacrylate, 0.5% by weight of sodium methallyl sulphonate and having a K-value of 83 (Fikentscher, Cellulosechemie 13, 1932, page 58) was then added, followed by stirring for 3.5 hours. The suspension was then passed through a filter press to remove swollen particles.

2. Preparation of a carbon black stock mixture 18.2 kg of dimethyl formamide (DMF) and 3.1 kg of a commercial-grade conductive carbon black, of the type used for electrically conductive lacquers and plastics, and having an average particle size of 23 mμ and a surface area of 150 $m^2/g$ (Corax L, a product of Degussa, Frankfurt-on-Main) were vigorously stirred with cooling over a period of 24 hours. Thereafter 11.3 kg of a 29.5% by weight solution of an acrylonitrile copolymer in DMF was added to the suspension, followed by stirring without cooling for another 3 hours. The acrylonitrile copolymer had the composition indicated above. To remove swollen particles, this mixture was passed through a filter press lined with cloths.

3. Production of the $TiO_2$-containing spinning solution A 2080 g of the $TiO_2$ stock mixture prepared as described in Example 1.1 was added to 40 kg of a 26.5% solution of the acrylonitrile copolymer described in Example 1.1 in dimethyl formamide, giving a $TiO_2$-content of 4.0%, based on the solids content of the pigmented spinning solution.

4. Production of the carbon-black-containing spinning solution B 25 kg of the stock mixture described in Example 1.2, 5.0 kg of the same acrylonitrile copolymer, 4.5 kg of DMF and 0.1 kg of isononyl phenol polyglycol ether were heated for 2 hours at 80° C. to dissolve the polymer. The suspension thus contained 25% of carbon black, based on the sum of the solids.

5. Spinning and aftertreatment

The spinning unit consisted of an 8.5 meters long 280 mm diameter duct, at the upper end of which a two-ring bifilar flow jet 0.25 mm in diameter containing 346 spinning bores was arranged. The two component streams A and B were delivered by means of two pumps having a chamber volume of 12 cc/revolution.

The two component suspensions A and B were heated to 110° C. The duct was heated to 160° C. and supplied with hot air to evaporate the solvent (air temperature: 350° C., quantity: 40 $m^3$/hour).

To spin the bifilar filament, the $TiO_2$-containing solution was initially delivered to the jet by the delivery pump rotating at a speed of 58 rpm, the spun filament being run off and wound at a speed of 200 meters per minute. After this brief start up phase, during which spinning became uniform, introduction of the second component stream containing carbon black was commenced at a pump speed of four revolutions per minute.

In this way, the ratio of the two polymer streams to one another was varied throughout the test which was also carried out with other various settings. The material wound into package form was then subjected to the same aftertreatment.

In this respect, the individual spinning band was initially drawn through a 4 meters long washing tank at a speed of 30 meters per minute without allowing shrinkage. The temperature of the washing water was 50° C. Washing was followed by drawing in a ratio of 1:2.1 in water heated to 70° C. and, after passing through a preparation tank, the spinning band was dried for about 40 seconds at 50° C. on a cylinder dryer, again without being allowed to shrink.

Finally, the spinning band was cut into 150 mm long fibres.

The fibre material had an average denier (before shrinkage) of 9 dtex, and a dumbbell-shaped cross-section. The differently pigmented portions were visible under an optical microscope (cf. FIG. 1).

The data of the fibres obtained with the individual test settings are set out in the following Table:

| Setting | r.p.m. pump for A | r.p.m. pump for B | Colour | Boiling induced shrinkage % | Resistance after release of shrinkage ohms | |
|---|---|---|---|---|---|---|
| 1 | 35 | 7 | grey-white | 36.5 | $3 \times 10^{10}$ | Before release of shrinkage, the resistance is higher by 3 to 10 powers of ten |
| 2 | 26 | 16.4 | grey | 34.0 | $2 \times 10^{7}$ | |
| 3 | 21 | 21 | grey | 32.6 | $4 \times 10^{5}$ | |
| 4 | 10 | 32 | grey-black | 35.1 | $2 \times 10^{4}$ | |
| 5 | 7 | 35 | black-grey | 34.3 | $5 \times 10^{4}$ | |

r.p.m. = revolutions per minute

6. Production of a velour carpet

A yarn (count 3.8/1) was spun from a mixture of 0.3% by weight of fibre obtained with test setting 3 and 99.7% by weight of a nylon-6 fibre with a denier of 20 dtex. A semi-worsted yarn, in which the fibre components were homogeneously mixed, was readily obtained by conventional worsted spinning processes without any need for auxiliaries. A carpet having a pile weight of 600 g/m$^2$ and a pile depth of 6 mm was produced from this yarn on a ⅛" tufting machine. The finished velour carpet was dyed a very light beige with a combination of standard commercial-grade acid dyes, the shrinkage of the grey bifilar polyacrylic fibres separately containing $TiO_2$ and carbon black being at the same time released. The carpet was then coated with a standard commercial-grade consolidating finish and a foam, both based on SBR-latex, 4% of a standard commercial-grade antistatic agent having been added to the precoating compound to improve intrinsic conductivity. Evaluation of the carpet did not reveal any adverse effect on its optical appearance. Antistatic behaviour: charge of 380 volts in individuals walking thereon.

7. Comparison Example

A carpet of nylon-6 fibre (20 dtex), to which the fibre according to the invention had not been added, was produced under otherwise exactly the same conditions for comparison with the above-mentioned floor covering. Evaluation of this carpet revealed a completely identical turn out with the above mentioned floor covering. Testing of the fastness and utility values also produced completely identical values for both carpets. Neither carpet was sensitive to staining by water. Antistatic behaviour: charges of more than 7000 volts in individuals walking thereon.

To test the permanence of the antistatic effect, both carpets were subjected for three months to a permanent threading test. Charging values in individuals after this period:

carpet of Example 1: <400 volts carpet of Comparison Example: >6500 volts.

8. Production of a tufted carpet

A yarn (count 2.8/1) was spun from a homogeneous mixture of 1.5% by weight of the fibre (staple length 100 mm) produced in the third setting and 98.5% by weight of a polycyclohexane dimethylol terephalate fibre with a denier of 6.7 dtex. A tufted carpet with a pile weight of 850 g/m$^2$ and a pile depth of 10 mm was then produced from this yarn on a 5/32" tufting machine. The tufted carpet was then dyed a light Berber colour with a standard commercial grade combination of dispersion dyes in the absence of a carrier, and shrinkage of the grey fibres separately containing $TiO_2$ and carbon black was also released. After this the tufted carpet was consolidated and coated in the same way as was the velour carpet. The grey fibre was not visible during evaluation, and instead a completely uniform balanced turn out of the carpet was obtained. Antistatic behaviour: charging: 600 volts.

9. Comparison Example

A floor covering consisting entirely of cyclohexyl dimethylol terephthalate fibres (6.7 dtex) was produced under otherwise exactly the same conditions. Antistatic behaviour: charging values in individuals: >5000 volts.

EXAMPLE 2

Production of a bifilar acrylic fibre separately containing carbon black and $TiO_2$ by using two different polymers:

1. Preparation of the polymer solution A containing $TiO_2$ 530 g of the stock mixture described in Example 1.1 was added to 40 kg of a 27% by weight solution in DMF of a polymer consisting of 90% by weight acrylonitrile, 5.5% by weight methylacrylate and 4.5% by weight dimethylaminoethyl methacrylate with a K-value of 84, after which addition the $TiO_2$, used in a quantity of 1%, based on solids, was thoroughly dispersed.

2. Preparation of the polymer solution B containing carbon black 15.1 kg of the filtered stock mixture described in Example 1.2, 4.7 kg of the acrylonitrile copolymer used in Example 1, 7.1 kg of DMF and 0.1 kg of isononyl phenol polyglycol ether were mixed and homogenised. The quantity of carbon black corresponded to 17.5% by weight, based on the solids.

3. Spinning and aftertreatment

Various test settings were again used in the same way as in Example 1. The spun material was aftertreated first by drawing in a ratio of 1:1.9 and then by washing. The temperatures, residence times and other conditions were the same as before. The fibres had dumbbell-shaped cross-sections. The separate $TiO_2$- and carbon-black-containing halves were visible under an optical microscope, the separation line running in the longitudinal direction.

The properties of the fibres having an average denier of 10.5 dtex are set out in the following Table:

| Setting | r.p.m. solution A | r.p.m. solution B | colour | boiling induced shrinkage % | resistance after full shrinkage ohms |
|---|---|---|---|---|---|
| 1 | 35 | 7 | grey-white | 39.5 | $3 \times 10^{9}$ |
| 2 | 29 | 12 | grey | 41 | $6 \times 10^{8}$ |
| 3 | 21 | 21 | grey | 41.5 | $3 \times 10^{6}$ |

-continued

| Setting | r.p.m. solution A | r.p.m. solution B | colour | boiling induced shrinkage % | resistance after full shrinkage ohms |
|---|---|---|---|---|---|
| 4 | 8 | 34 | black-grey | 38.6 | $6 \times 10^4$ |

4. Velour carpet

A velour carpet was produced and finished in the same way as in Example 1 using a mixture of 99% by weight of nylon-6 fibre and 1% by weight of the fibre obtained with setting 3. The charging level in individuals amounted to 520 volts.

EXAMPLE 3

Production of a bifilar acrylic fibre separately containing carbon black and $TiO_2$ by using a polymer and a mixture of two polymers.

1. Production of the $TiO_2$-containing component stream A

A mixture of 80% by weight of an acrylonitrile homopolymer (K-value 89) and 20% by weight of a copolymer consisting of 91.5% by weight of acrylonitrile, 5.5% by weight of methylacrylate and 3% by weight of sodium methallyl sulphonate (K-value 82) was dissolved in DMF so that the solids concentration was 24.5%. 960 g of the $TiO_2$ stock mixture described in Example 1.1 was added to 40 kg of this solution so that the $TiO_2$ content of the solution was 2%, based on solids.

2. The carbon-black-containing solution used was the same as in Example 2.2 (component stream B).

3. Spinning and aftertreatment

Spinning and aftertreatment were carried out in the same way as in Example 2. The fibres had mushroom-shaped, lip-shaped and, in some cases, dumbbell-shaped cross-sections. The differently pigmented components were discernible under an optical microscope.

| Setting | r.p.m. component stream A | r.p.m. component stream B | Colour | Boiling induced shrinkage % | Resistance after release of shrinkage ohms | |
|---|---|---|---|---|---|---|
| 1 | 30 | 12 | grey | 28.3 | $9 \times 10^{10}$ | Before shrinkage is released, the resistance is higher by 3 to 10 powers of ten |
| 2 | 21 | 21 | grey | 31.2 | $4 \times 10^5$ | |
| 3 | 17 | 25 | black | 27.5 | $8 \times 10^4$ | |

4. Production of a tufted carpet

A mixed yarn (count 3.5/1) was produced from a mixture of 4% of the fibre described under test setting 2 with 96% of a polyacrylonitrile fibre (94% of acrylonitrile, 5.5% of methacrylate, 0.5% of sodium methallyl sulphonate): (17 dtex), and subsequently processed into a tufted carpet having a pile weight of 850 g/m$^2$ and a pile depth of 10 mm. The polyacrylonitrile fibre had been previously flock-dyed an "olive" colour using standard commercial-grade dyes. It was latexed (cf. Example 1), shrinkage of the bifilar fibre containing $TiO_2$ and carbon black being released, and then coated. The carbon black/$TiO_2$-containing components of the fibre were not evident on visual evaluation. Antistatic behaviour: charge of 780 volts.

5. Comparison Example

100% polyacrylonitrile fibre was used, otherwise the procedure was the same as before. Charging values in individuals: $>5000$ volts.

We claim:

1. A fibre or filament mixture consisting of 0.1 to 20% by weight of high shrinkage side-by-side bifilar(mod)acrylic fibres or filaments separately containing $TiO_2$ and carbon black, and 99.9 to 80% by weight of normal fibres or filaments selected from the group of polyamide, polyester, polyalkene, poly(mod)acrylic, wool, cotton and mixtures thereof.

2. The fibre or filament mixture of claim 1, wherein the by weight ratio of said $TiO_2$-containing fibre or filament side to said carbon-black-containing fibre of filament side amounts to between 90:10 and 10:90.

3. The fibre or filament mixture of claim 1, wherein the $TiO_2$-content of said $TiO_2$-containing fibre or filament side amounts to between 0.1 and 4% by weight, and the carbon black content of said carbon-black-containing fibre or filament side amounts to between 12.5 and 30% by weight.

4. The fibre or filament mixture of claim 1 wherein said bifilar(mod)acrylic fibres or filaments separately containing $TiO_2$ and carbon black have a boiling-induced shrinkage of from 10 to 50%.

5. A fibre or filament mixture according to claim 1 containing isononyl phenol polyglycol ether.

* * * * *